US007148783B2

(12) United States Patent
Parsche et al.

(10) Patent No.: US 7,148,783 B2
(45) Date of Patent: Dec. 12, 2006

(54) MICROWAVE TUNABLE INDUCTOR AND ASSOCIATED METHODS

(75) Inventors: Francis Eugene Parsche, Palm Bay, FL (US); Enrique Ruiz, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 112 days.

(21) Appl. No.: 10/982,040

(22) Filed: Nov. 5, 2004

(65) Prior Publication Data

US 2006/0097838 A1 May 11, 2006

(51) Int. Cl.
*H01F 27/28* (2006.01)

(52) U.S. Cl. ..... 336/225; 336/226

(58) Field of Classification Search ..... 336/225–226, 336/82; 333/175
See application file for complete search history.

(56) References Cited

U.S. PATENT DOCUMENTS 5,057,809 A * 10/1991 Chandler et al. ..... 336/144
6,005,467 A 12/1999 Abramov ..... 336/200
6,171,240 B1 * 1/2001 Young et al. ..... 600/410
6,417,754 B1 7/2002 Bernhardt et al. ..... 336/200
6,509,821 B1 1/2003 Oldfield ..... 336/82
6,882,785 B1 * 4/2005 Eichelberger et al. ..... 385/101
2004/0004527 A1 1/2004 Geller et al. ..... 336/225

OTHER PUBLICATIONS

K, RF & Microwave Corp., "Mocrowave Inductor KC3 Series" dated Jan. 2003; www.krfm.co.jp.

* cited by examiner

*Primary Examiner*—Anh Mai
(74) *Attorney, Agent, or Firm*—Allen, Dyer, Doppelt, Milbrath & Gilchrist, P.A.

(57) ABSTRACT

The inductor, preferably a microwave tunable inductor, includes first and second wires twisted together to define a double helix having a first end and second end with a plurality of twists therebetween. First and second terminals are at the first end of the double helix, and a connection at the second end of the double helix electrically connects the first and second wires in series. The inductance is tuned by adjusting a number of twists in the double helix, and the inductance includes a linear tuning range based upon between about 3 to 10 twist for a tuning range of about 7–12 Nanohenries. The inductor can also resonate and filter, and the double helix affords numerous advantages over conventional single helix inductors.

23 Claims, 4 Drawing Sheets

MICROWAVE TUNABLE INDUCTOR AND ASSOCIATED METHODS

FIELD OF THE INVENTION

The present invention relates to the field of wireless communications, and more particularly, the invention relates to a microwave inductor with linear tuning and related methods.

BACKGROUND OF THE INVENTION

Inductors are a fundamental electromagnetic component necessary to a wide variety of devices, such as actuators, relays, motors, DC-to-DC converters and radio frequency (RF) circuits. Inductors having large inductances typically include wires wrapped around a bulk dielectric or ferromagnetic core, and are used in power converters and relays. Radio frequency inductors having small inductances typically are helical coils having an air or ferrite core, and are used in RF circuits and communications equipment.

Inductors for the microwave region can become too small to fabricate and suffer low efficiency and Q values. Conventional RF inductor techniques must often be abandoned. For instance, the ferrite core, or tunable coil slug, is unusable above VHF due to eddy current losses in the ferrite. Even printed spiral inductors have limited usefulness at microwave frequencies, as magnetic field circulation through silicon substrates results in eddy-current loss, and a higher than normal parasitic capacitance.

Therefore, there exists a need for a microwave inductor of practical size and construction, with high Q and efficiency, and having adjustable or tunable features. With radio communications moving to higher and higher frequencies, the need is becoming ever more acute. A typical RF communication device, such as a cellular telephone uses inductors with an inductance in the range of 5–12 nH (nanohenries).

For example, U.S. Pat. No. 6,005,467 to Abramov is directed to a trimmable inductor including a supporting substrate having spaced apart lead terminals, a coil defined by an electrically conductive member mounted on the substrate in a continuous path of multiple turns forming a winding about an axis extending between the lead terminals, and an electric conductive shorting member extending and electrically connected between at least two adjacent windings of the coil to enable selective inclusion and elimination of one of the windings. Cuts are made in the conductors or shorting member to trim the inductor.

SUMMARY OF THE INVENTION

In view of the foregoing background, it is therefore an object of the present invention to provide a practical microwave tunable inductance.

This and other objects, features, and advantages in accordance with the present invention are provided by an inductor, preferably a microwave tunable inductor, including first and second wires twisted together to define a double helix having a first end and second end with a plurality of twists therebetween. First and second terminals are at the first end of the double helix, and a connection at the second end of the double helix electrically connects the first and second wires in series.

An inductance tuning tool may be provided for tuning the inductance of the double helix. The inductance tuning tool preferably includes a dielectric tube having an internal slot therein for mating with the second end of the double helix.

The inductance is varied by adjusting the twists in the double helix with the inductance tuning tool, and the inductance includes a linear tuning range based upon between about 3 to 10 twists in the double helix. The linear tuning range may be between about 7–12 Nanohenries. Insulation coating is provided on the first and second wires, and each of the first and second wires may comprise solid copper wire, e.g. between about #22 and #26 AWG (American Wire Gauge).

Another aspect of the invention is directed to a Radio Frequency (RF) communication device including a substrate and an RF circuit on the substrate. The RF circuit includes a printed circuit, and a microwave tunable inductor connected to the printed circuit. The inductor includes first and second wires twisted together to define a double helix having a first end and second end with a plurality of twists therebetween. First and second terminals are at the first end of the double helix, and a connection at the second end of the double helix electrically connects the first and second wires in series.

Another aspect of the invention is directed to a method of making an inductor comprising twisting first and second wires together to define a double helix having a first end and second end with a plurality of twists therebetween, providing first and second terminals at the first end of the double helix, electrically connecting the first and second wires in series at the second end of the double helix, and tuning an inductance of the double helix by adjusting the twists in the double helix. The inductance is preferably varied by adjusting the number of twists in the double helix with an inductance tuning tool comprising a dielectric tube having an internal slot therein for mating with the second end of the double helix. The inductance is tuned in a linear tuning range between about 3 to 10 twists in the double helix, and the linear tuning range is between about 7–12 Nanohenries.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
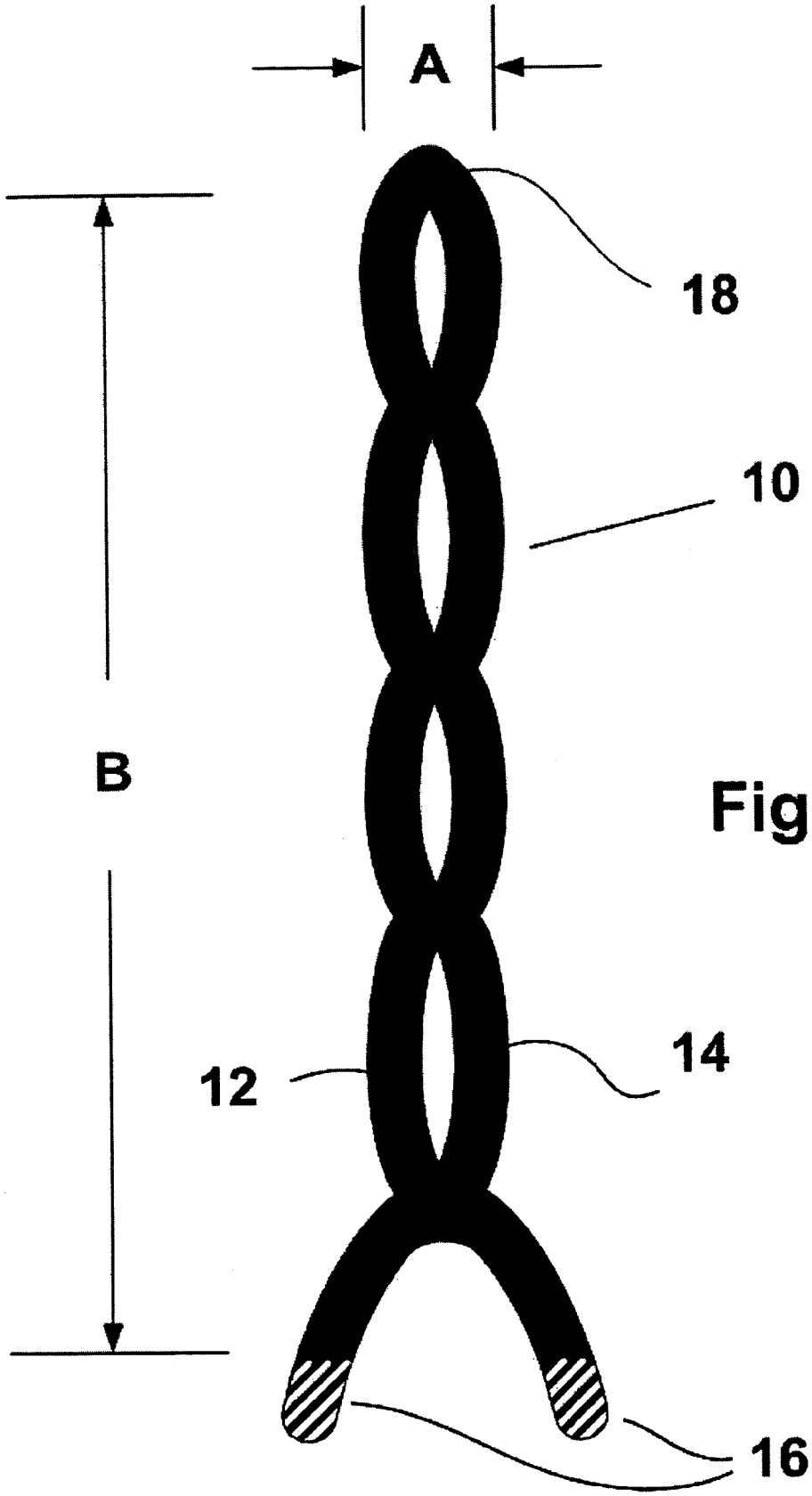
FIG. 1 is a schematic diagram of a microwave tunable inductor in accordance with the present invention.

Referring initially to FIG. 1, an inductor 10, such as a microwave tunable inductor or bifilar helix inductor, in accordance with the present invention will now be described. The inductor 10 includes first 12 and second 14 wires twisted together to define a double helix having a first end and second end with a plurality of twists therebetween.

First and second terminals 16 are at the first end of the double helix, and a connection 18 at the second end of the double helix electrically connects the first and second wires in series and provides a short circuit there.

In one embodiment, the inductor 10 is formed from one continuous wire, such that the first 12 and second 14 wires are provided by using a single length of wire doubled back upon itself. This embodiment automatically provides the connection 18 as first 12 and second 14 wires are continuous. The invention is not however so limited as to require this particular embodiment, and first 12 and second 14 wires may be discrete wire segments twisted, soldered, crimped, or otherwise caused to have conductive contact at connection 18.

The width A of the inductor may typically be between 0.002 to 0.02 wavelengths, for example. Also, the length B may typically be between 0.02 to 0.16 wavelengths, for example.

Figure 2:
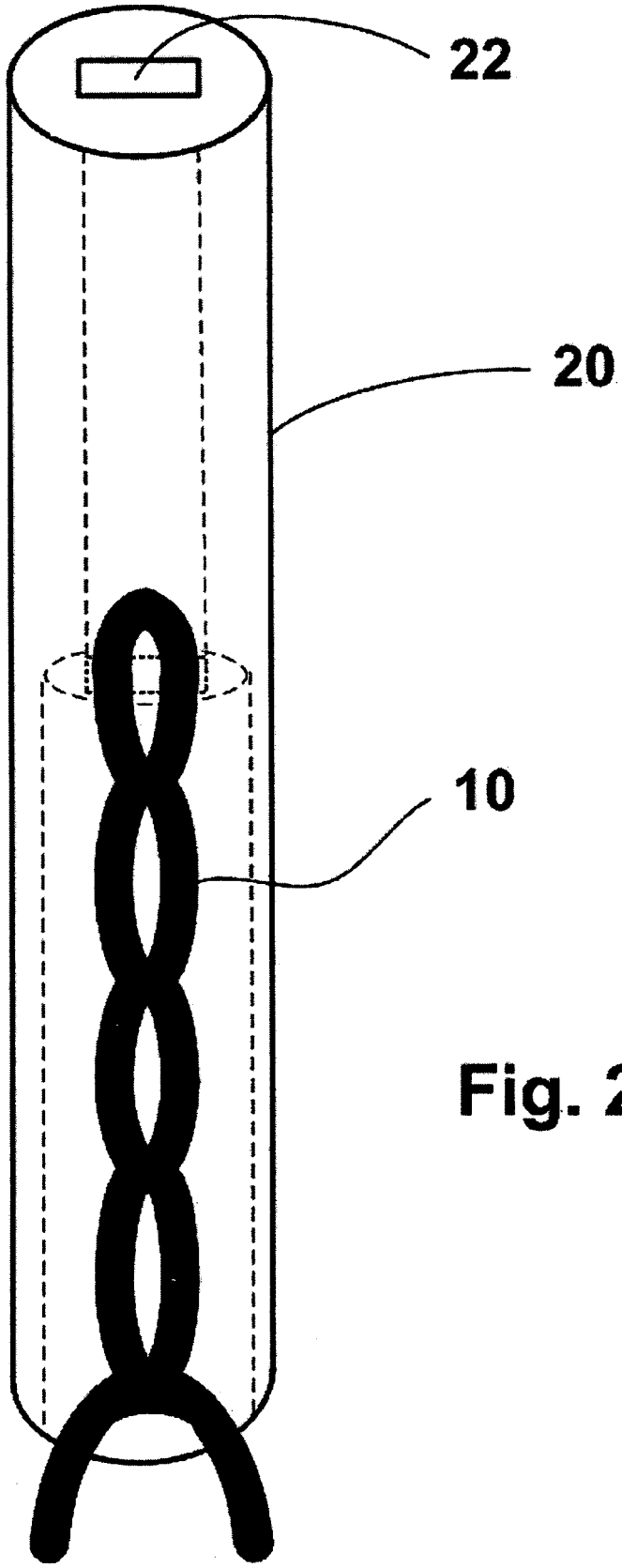
FIG. 2 is a schematic diagram illustrating an inductance tuning tool with the microwave tunable inductor of FIG. 1.

Referring to FIG. 2, an inductance tuning tool 20 may be provided for tuning the inductance of the inductor 10. The inductance tuning tool 20 preferably includes a dielectric tube 21 having an internal slot 22 therein for mating with the second end of the double helix. The inductance is varied by adjusting the twists, e.g. the number of twists, in the inductor 10 with the inductance tuning tool 20.

Figure 4:
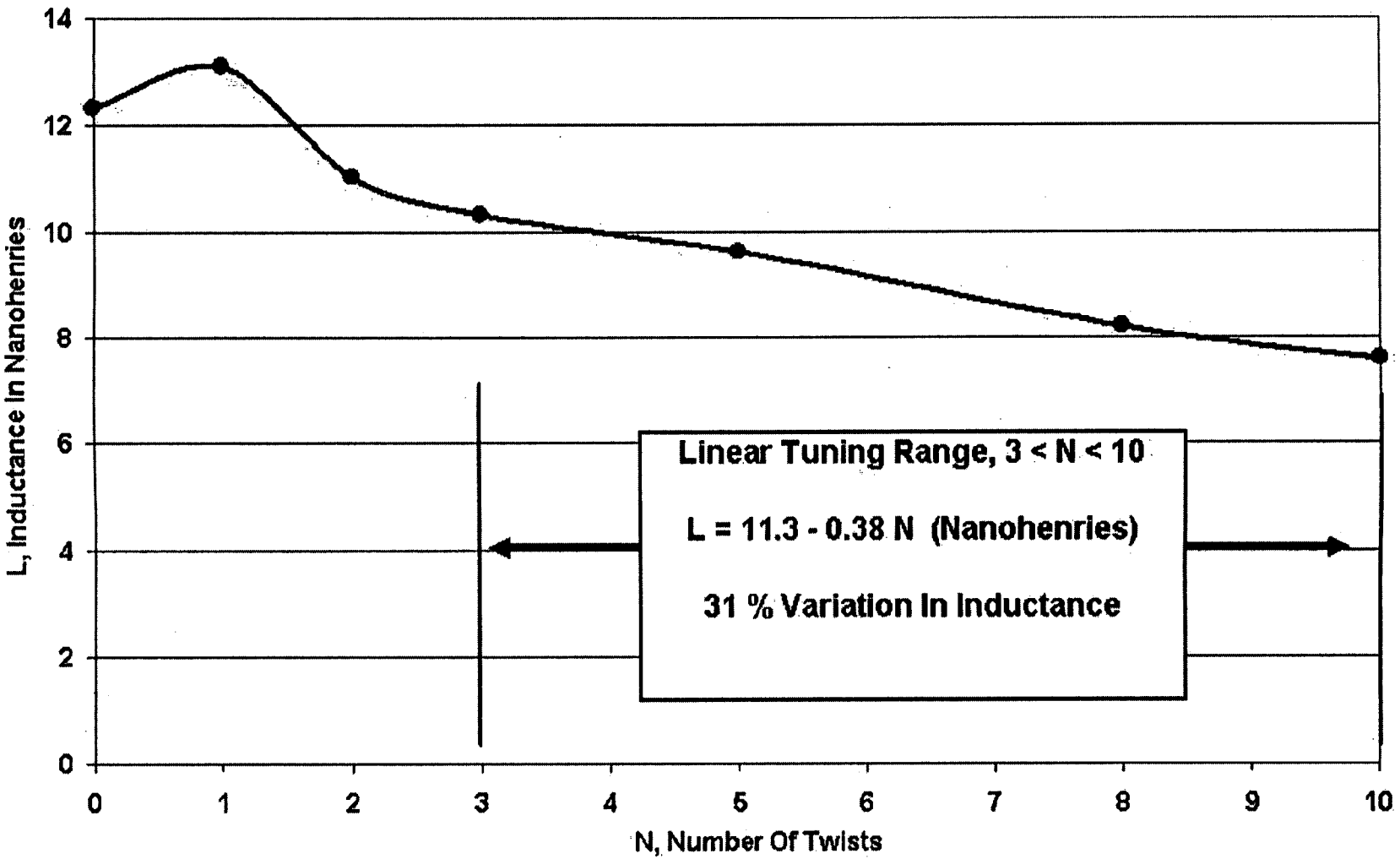
FIG. 4 is a graph illustrating the relationship between the number of twists vs inductance of an example of a microwave tunable inductor in accordance with the present invention.

In the example illustrated, and in reference to the graph of FIG. 4, the inductance includes a linear tuning range based upon between about 3 to 10 twists in the double helix. The linear tuning range may be between about 7–12 nH (nanohenries), at a frequency near 1300 Mhz. Each of the first and second wires 12, 14 may comprise solid copper wire, e.g. between about #22 and #26 AWG (American Wire Gauge). In the example, a single 0.700 inch length of #24 AWG enameled solid copper magnet wire was used to form the inductor 10, and the resultant inductor 10 stood about 0.350 inches tall.

Figure 3:
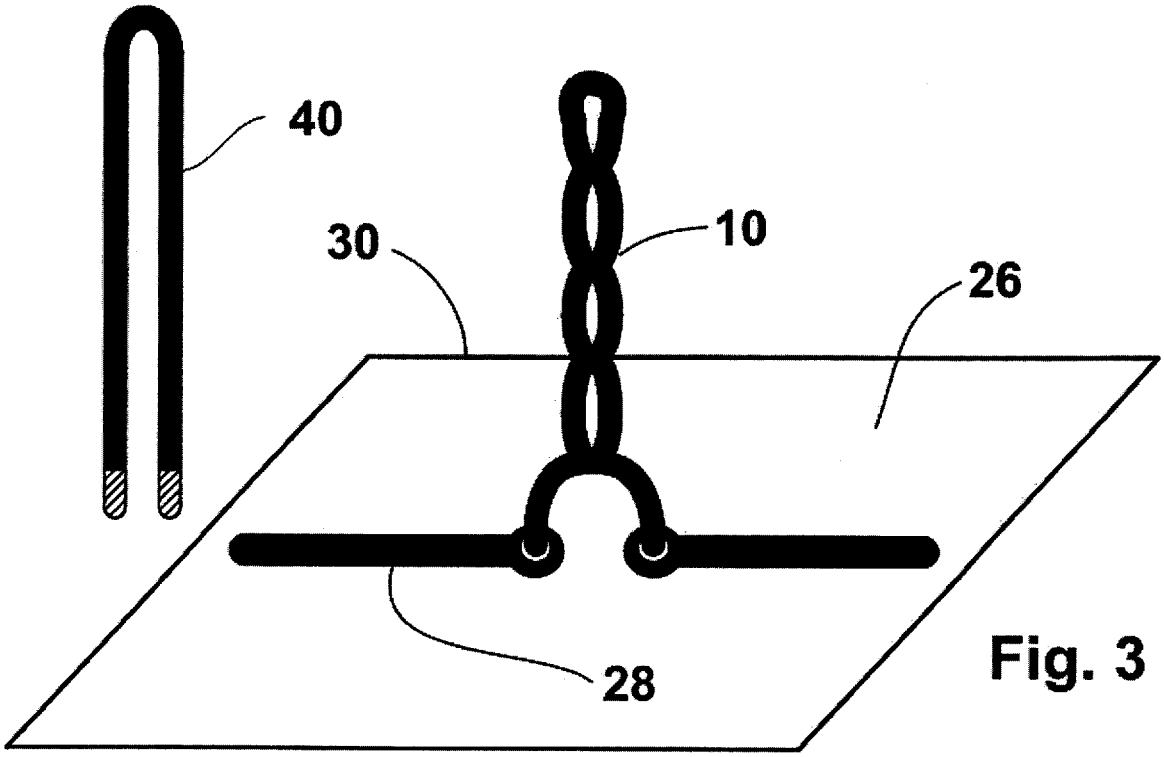
FIG. 3 is a schematic diagram of an RF communication device including the microwave tunable inductor of FIG. 1.

Referring now additionally to FIG. 3, another aspect of the invention is directed to an RF communication device 24 such as a mobile telephone or a wireless mobile node of a mobile network, for example. The RF device 24 includes a substrate 26 and an RF circuit trace 28 on the substrate. The RF circuit trace 28 includes a printed circuit 30, and a microwave tunable inductor 10 connected to the printed circuit. As discussed, the inductor 10 includes first and second wires 12, 14 twisted together to define a double helix having a first end and second end with a plurality of twists therebetween. First and second terminals 16 are at the first end of the double helix and connect the inductor to the printed circuit. A connection 18 at the second end of the double helix electrically connects the first and second wires 12, 14 in series. A hairpin wire may be used in an intermediate step in the manufacture of inductor 10. The printed circuit 30 may be first populated with such hairpin wire, and the double helix of first and second wires 12, 14 formed in situation with inductance tuning tool 20.

Another aspect of the invention is directed to a method of making an inductor 10 comprising twisting first and second wires 12, 14 together to define a double helix having a first end and second end with a plurality of twists therebetween, providing first and second terminals 16 at the first end of the double helix, electrically connecting the first and second wires in series at the second end 18 of the double helix, and tuning an inductance of the double helix by adjusting a number of twists in the double helix. The inductance is preferably varied by adjusting the number of twists in the double helix with an inductance tuning tool 20 comprising a dielectric tube 21 having an internal slot 22 therein for mating with the second end of the double helix. The inductance is tuned in a linear tuning range based upon between about 3 to 10 twists in the double helix, and the linear tuning range is between about 7–12 Nanohenries.

In a preferred embodiment, first 12 and second 14 double helix wires are formed closely adjacent, causing the invention to operate as a distributed element and twisted pair RF transmission line, with a short circuited end. The invention is not so limited however, as to require that first 12 and second 14 wires touch or be particularly close to each other, and lumped modes can be obtained if desired.

Inductor 10 minimum inductance and range of inductance variation can be set by adjusting the inventions physical parameters, including wire length l, wire diameter D, insulation type, wire gauge and construction, helix diameter, and twist per inch T. This invention may be scaled to any frequency of operation and inductance as would be appreciated by those skilled in the art.

Analytic design for a specific inductance or inductive reactance may be accomplished by using the formula for the impedance of a shorted transmission line stub, which is:

$$X_L = -j\, Z_0 \cot(\beta \mathbf{1})$$

Where:

$X_L$=Inductive Reactance $Z_0$=Characteristic Impedance Of The Double Helix As A Transmission Line $\beta$=Phase Propagation Constant=$2\Pi/\lambda$ l=Length Of The Double Helix $\lambda$=Wavelength.

Inductance L is then obtained by:

$$L = X_L / 2\Pi F$$

Where:

F=Frequency

Characteristic Impedance $Z_0$ may range from 10 to 85 ohms, and $Z_0$ decreases with increasing twists per inch T of first 12 and second 14 wires. Specific values of $Z_0$, for various constructions, can be obtained from the paper "*Twisted Magnet Wire Transmission Line*", Peter Lefferson, K4POB, IEEE Transactions on Parts, Hybrids, and Packaging, PHP-7, No. 4, December 1971, pp. 148–154 which is incorporated by reference herein in its entirety. The invention may also be designed empirically. Prototypes are readily constructed by hand.

A secondary design parameter in the invention is the pitch or "twist" angle $\theta$. This is the angle between the centerline and axis or rotation of the double helix, and the inclined orientation of first 12 and second 14 wires. Twist angle $\theta$ may be calculated as follows:

$$\theta = \tan^{-1}(\Pi D\, T)$$

Where:

$\theta$=Twist Angle $\Pi$=3.14

D=Wire Outer Diameter, Including Insulation

T=Twists Per Inch or Twists Per Unit Length

Typical values for $\theta$ range between 9 and 36 degrees. The invention is not so limited to these angles however, and it performs well electrically at all twist angles. Wire breakage occurs near 51 degrees twist angle, which is a fundamental limit in twisted structures. When tightly twisted first 12 and second 14 wires incur work hardening. This is structurally beneficial in some applications. Soft drawn or annealed magnet wire is a preferred material for first 12 and second 14 wires, and first and second terminals 16 may be formed by tinning the ends of first 12 and second 14 wires by dipping them into a pot of molten solder.

The invention may be finely adjusted by even non-skilled operators, as the twisting action of adjustment is smooth and linear. This is advantageous with respect to the turn spreading process used to with prior art single helix inductors. The inductance of this double helix invention decreases with an increase of twists T. Prior art single helix inductors operate in reverse, with their inductance L increasing with an increase in turns N.

The helix of inductor 10 may of course be twisted clockwise or counter clockwise with inductance tuning tool 20. Once twisted, the inductance of inductor 10 may be increased by the rotation sense that untwists the double helix formed by first 12 and second 14 wires.

Another benefit of this invention, is that inductor 10 is by nature a slender device. The invention takes up much less circuit board area than do the prior art single helix coil inductors. Inductor 10 has the additional advantage of not requiring a coil form, although a form can be employed if desired.

Fundamental (¼ wave) resonance has been measured at the terminals of inductor 10 when enameled magnet wire was used for first 12 and second 14 wires and length B was physically about 0.16 to 0.18 wavelengths long. Inductor 10 is by nature a slow wave device, and length B at ¼ wave resonance is physically shorter than ¼ wavelength in air. Velocity of propagation along the double helix decreases with an increase in the number of twists T, and the velocity factor V has been measured to be between 0.6 to 0.8 in some designs.

The invention has yet another beneficial mode of operation; when the length B of inductor 10 is at fundamental (¼ wave) resonance the invention can function as a tunable resonator or filter. For instance, when inductor 10 is so resonated and paralled across a RF network or communications channel, a broad band pass response is obtained. When inductor 10 is at ½ wave resonance and similarly paralled, a narrow band stop response is obtained. Broad or narrow band pass or band stop responses may be obtained at will, by series and parallel network connections of inductor 10, by those so skilled in the art.

Inductor 10 of the present invention is by nature an electrically balanced device, operable above electrical ground. Inductor 10 can also be more economical and easier to fabricate than the single helix of prior art helical resonators, which often comprise a single helix in a metal tube.

Inductor 10 is an effective RF choke when first 12 and second 14 wires are about ¼ wavelength individually and the invention is twisted to resonance. Inductor 10 may thus be used to supply DC power to a transistor RF amplifier, or elsewhere to cause a DC only ground.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An inductor comprising:

first and second wires twisted together to define a double helix having a first end and second end with a plurality of twists therebetween;

first and second terminals at the first end of the double helix; and a connection at the second end of the double helix electrically connecting the first and second wires in series;

an inductance of the double helix being tuned based upon the plurality of twists in the double helix, and the inductance including a linear tuning range based upon between about 3 to 10 twists in the double helix.

2. The inductor according to claim 1 a wherein the linear tuning range is between about 7–12 Nanohenries.

3. The inductor according to claim 1 further comprising insulation coating on the first and second wires.

4. The inductor according to claim 1 wherein each of the first and second wires comprises solid copper wire.

5. The inductor according to claim 4 wherein the solid copper wire is between about #22 and #26 AWG (American Wire Gauge).

6. A microwave tunable inductor comprising:

first and second wires twisted together to define a double helix having a first end and second end with a plurality of twists therebetween;

first and second terminals at the first end of the double helix;

a connection at the second end of the double helix electrically connecting the first and second wires in series; and an inductance tuning tool for tuning the inductance of the double helix, the inductance tuning tool comprising a dielectric tube having an internal slot therein for mating with the second end of the double helix.

7. The microwave tunable inductor according to claim 6 wherein the inductance is tuned by adjusting a number of twists in the double helix with the inductance tuning tool.

8. The microwave tunable inductor according to claim 7 wherein the inductance includes a linear tuning range based upon between about 3 to 10 twists in the double helix.

9. The microwave tunable inductor according to claim 8 wherein the linear tuning range is between about 7–12 Nanohenries.

10. The microwave tunable inductor according to claim 6 further comprising insulation coating on the first and second wires.

11. The microwave tunable inductor according to claim 6 wherein each of the first and second wires comprises solid copper wire.

12. The microwave tunable inductor according to claim 11 wherein the solid copper wire is between about #22 and #26 AWG (American Wire Gauge).

13. A Radio Frequency (RF) communication device comprising:

a substrate; and an RF circuit on the substrate and comprising a printed circuit, and a microwave tunable inductor connected to the printed circuit and comprising first and second wires twisted together to define a double helix having a first end and second end with a plurality of twists therebetween, first and second terminals at the first end of the double helix and connected to the printed circuit, and a connection at the second end of the double helix electrically connecting the first and second wires in series, an inductance of the microwave tunable inductor including a linear tuning range based upon between about 3 to 10 twists in the double helix.

14. The RF communication device according to claim 13 wherein the linear tuning range is between about 7–12 Nanohenries.

15. The RF communication device according to claim 13 wherein the microwave tunable inductor further comprises insulation coating on the first and second wires.

16. The RF communication device according to claim 13 wherein each of the first and second wires of the microwave tunable inductor comprises solid copper wire.

17. The RF communication device according to claim 16 wherein the solid copper wire is between about #22 and #26 AWG (American Wire Gauge).

18. A method of making an inductor comprising:

twisting first and second wires together to define a double helix having a first end and second end with a plurality of twists therebetween;

providing first and second terminals at the first end of the double helix;

the first and second wires being electrically connected in series at the second end of the double helix; and tuning an inductance of the double helix by adjusting the number of twists in the double helix with an inductance tuning tool comprising a dielectric tube having an internal slot therein for mating with the second end of the double helix.

19. The method according to claim 18 wherein the inductance is tuned in a linear tuning range based upon between about 3 to 10 twists in the double helix.

20. The method according to claim 19 wherein the linear tuning range is between about 7–12 Nanohenries.

21. The method according to claim 18 further comprising providing insulation coating on the first and second wires.

22. The method according to claim 18 wherein each of the first and second wires comprises solid copper wire.

23. The method according to claim 22 wherein the solid copper wire is between about #22 and #26 AWG (American Wire Gauge).

* * * * *

UNITED STATES PATENT AND TRADEMARK OFFICE

CERTIFICATE OF CORRECTION

PATENT NO. : 7,148,783 B2
APPLICATION NO. : 10/982040
DATED : December 12, 2006
INVENTOR(S) : Parsche et al.

It is certified that error appears in the above-identified patent and that said Letters Patent is hereby corrected as shown below:

Column 6, Line 8 Delete: "a wherein"
Insert -- wherein --

Signed and Sealed this

Third Day of July, 2007

JON W. DUDAS
*Director of the United States Patent and Trademark Office*